United States Patent [19]

Matsubara et al.

[11] 3,945,858

[45] Mar. 23, 1976

[54] METHOD OF MANUFACTURING STEEL FOR LOW TEMPERATURE SERVICES

[75] Inventors: Hiroyoshi Matsubara; Tatsumi Osuka; Tadao Sugiyama, all of Fukuyama, Japan

[73] Assignee: Nippon Kokan Kabushiki Kaisha, Tokyo, Japan

[22] Filed: Mar. 18, 1974

[21] Appl. No.: 451,953

[30] Foreign Application Priority Data

Mar. 19, 1973 Japan ..... 48-30854

[52] U.S. Cl. ..... 148/2; 148/12 F

[51] Int. Cl.[2] ..... C21D 7/13

[58] Field of Search ..... 148/12 C, 12 F, 2, 3; 75/123 E, 128 E

[56] References Cited

UNITED STATES PATENTS

| | | | |
|---|---|---|---|
| 2,823,992 | 2/1958 | Bolkcom et al. | 75/123 E |
| 3,666,452 | 5/1972 | Korchynsky et al. | 148/12 F |
| 3,666,570 | 5/1972 | Korchynsky et al. | 148/12 F |
| 3,671,336 | 6/1972 | Korchynsky et al. | 148/12 F |
| 3,711,340 | 1/1973 | Korchynsky et al. | 148/36 |
| 3,806,378 | 4/1974 | Bramfitt et al. | 148/12 F |

*Primary Examiner*—W. Stallard

*Attorney, Agent, or Firm*—Flynn & Frishauf

[57] ABSTRACT

A low alloy steel substantially consisting of Ni-Cr-Cu-Nb system and further adding 0.01 to 0.10% rare earth metals or their alloy thereto, and then being as only hot-rolled by 30 to 80% rolling rate at a temperature of less than 950°C. The steel exhibits absorption energy of at least 10kg-m at −20°C and a $_{D}T_{C}$ transition temperature of lower than −40°C, if necessary, may be tempered at a temperature of 500° to 680°C to improve the properties.

2 Claims, No Drawings

METHOD OF MANUFACTURING STEEL FOR LOW TEMPERATURE SERVICES

The present invention relates to an improvement in the manufacturing method of steels for low temperature services, and more in particular, method of manufacturing steels having high notch toughness at low temperature with low cost, even if the steels are as only hot-rolled.

As a steel for low temperature services, the steels such as those containing more than 2.0% Ni which exceeds the limit provided in ASTM – A203, i.e. 2.5% Ni steel and 3.5% Ni steel, are given normalizing, or normalize-tempering treatment or other low alloy steels are given quench-tempering treatment in the art. There were various problems encountered in the manufacture of these steels for low temperature services and the manufacture thereof is truly difficult. For instance, the above mentioned Ni steel costs a lot since Ni is extremely expensive and special cares are required in the respective steps of refining, ingot making, heating, rolling, etc. As has been mentioned in the above, both cases of said Ni steels and other low alloy steels necessarily increase the cost in manufacture since such heat-treating as normalizing, normalize-tempering or quench-tempering are required, and cause disadvantages as the likelihood of damages during heat treating. It is also well known that such a steel sheet when used for tubing purposes for pipe lines brings about other problems; that is, the tubing material such as these are manufactured either by tubing after heat treating as mentioned above, or by heat-treating after tubing. When the later method is applied to large diameter pipe, there are seen many problems such as difficulties in uniform heating and cooling (quenching) over the whole length of the pipe, maintainance of optimum quenching temperature, prevention of deformation of outer surface, out of roundness, or camber of pipe, which problems are caused by the heat treatment and which problems still await solution. No effective and suitable means have been found to place the production using these methods on an industrial scale. However, various more severe demands are being made recently toward steels for low temperature services in spite of the above going situation, and in particular the requirements for the materials for pipe lines (such as notch toughness at low temperature, etc.) to be laid out in such cold areas as the Artic. As one measure for solving this problem, the applicant for this application proposed the invention as disclosed in Japanese Patent Application No. 48-17882 (i.e. No. 17882/73). The said invention concerns the steels with excellent low temperature toughness and high yield point under a state as only hot-rolled without being given the above mentioned heat treatment, or, if necessary, as only tempered thereon. However, even this steel required a content of at least 1.4% of Ni. Although many of the disadvantages as mentioned above may be removed by the said invention, the higher cost caused by the addition of 1.4% Ni cannot be avoided. The present invention made a further improvement on this point by eliminating the said heat treatment and radically reducing the Ni content as well as eliminating said heat treatment, while successfully obtaining a more excellent notch toughness at low temperature.

Thus, the prior art is improved at a point of reducing Ni content in steel of Cr-Ni-Cu-Nb system, i.e. 0.05 to 0.50% Ni. To make up for reducing said content of Ni, rare earth metals or their alloy of 0.01 to 0.20% is added to said liquid steel at the stage of vacuum degassing treatment or pouring into a mold and then said steel is hot-rolled by a rolling rate at temperature of below 950°C of 30 to 80% to the finished thickness, further, if necessary, is only tempered at a temperature of 500° to 650°C.

An object of this invention is to provide a low alloy steel for low temperature services satisfying the requirements that absorption energy at −20°C is at least 10kg-m and $_DT_C$ transition temperature is at most −40°C.

Another object of this invention is to provide a low alloy steel fit to be used in such very cold area as the polar regions.

Other objects and advantages will be apparent from the following description.

The first feature of this invention lies in the following chemical composition. That is;

| | |
|---|---|
| 0.02 to 0.10% C, | 0.10 to 0.50% Si, |
| 1.20 to 1.80% Mn, | less than 0.030% P, |
| less than 0.015% S, | 0.05 to 0.50% Ni, |
| 0.05 to 0.50% Cr, | 0.05 to 0.50% Cu |
| 0.01 to 0.10% Nb, | unavoidable impurities |
| the balance being Fe. | |

Further rare earth metal or its alloy of 0.01 to 0.20% is added to liquid steel consisting of the above composition.

C: It is an element for which it is inexpensive to maintain the strength, but the upper limit is placed at 0.10% because it lowers the absorption energy and weldability. The lower limit was set at 0.02% as that which should maintain the strength and should offer industrial solution.

Si: Si is an indispensable and inexpensive deoxidation element in manufacturing sound steel, and it must be contained in steel by more than 0.1%. However, content in excess of 0.5% will make worse weldability and toughness.

Mn: Mn is effective in improving the strength without lowering toughness, and for this reason its content should be over 1.20%. However, Mn in excess of 1.80% will damage weldability.

P & S: P and S are the impurities unavoidably present in steel and therefore their contents should be as low as possible. However, comparatively controllable upper limits were set at 0.030 and 0.015% respectively.

Ni, Cu and Cr: These three elements are contained with a view to increase the strength without damaging the toughness. However, less than 0.05% content for these elements exhibit little additive effects and their upper limit on the other hand is set at 0.50% respectively in view of cost and weldability.

Nb: Nb is an indispensable element for improving strength and transition temperature and for refining the structure. For this purpose, at least 0.01% or more Nb content is necessary, but more than 0.10% of the same will bring about lowering of absorption.

Rare earth metal or its alloy: mischmetal, Rare Earth Silicide, Lan Cer Amp or Lexalite is employed as a rare earth metal or its alloy in this invention. These metals act to lower the absorption energy, but to eliminate harmful S from steel, and are very effective in changing the sulfide in steel to one which is little deformed by rolling. For the above mentioned purposes, it is necessary to add more than 0.01% of them. However, addition in a great amount rather increases harmful inclusions and makes worse the hot-workability, so that the upper limit is limited to 0.20%. Such a rare earth metal or its alloy is restricted in said addition amount to liquid steel which is different from those of other elements. The reason for this is because there is no sure way established of analyzing the amount of rare earth metal present in steel. Another reason is that a distinctive difference appears in steel even if the analysis is of said rare earth metal or its alloy resulted in a trace. Such rare earth metals are added at the stage of vacuum degassing or of pouring into a mold to liquid steel. In such a case, said degassing is not always needed.

The second feature of this invention lies in the requirements of hot-rolling the steel consisting of the above composition and further adding said rare earth metal or its alloy thereto. For such a steel, certain limits are placed on the reduction ratio in connection with rolling temperature. If the steel is to be hot rolled under normal conditions, some improvement may be seen in impact absorption energy, but its transition temperature rises and it has been confirmed that the maintaining of ${}_{D}T_{C}$ transition temperature below −40°C in load tests becomes difficult. Therefore, the said certain limit is to be set at the minimum rolling rate of 30% to steel of below 950°C. However, if the rolling rate is made excessively larger in the low temperature zone, the absorption energy will become inferior and the rolling efficiency will also become lowered. That is the reason for limiting the upper limit at 80%.

The third feature of this invention lies in the heat-treating of the above steel. This invention steel exhibits satisfactory low temperature properties, i.e. absorption energy of more than 10kg-m at −20°C and ${}_{D}T_{C}$ transition temperature of below −40°C, even if as only hot-rolled. However, if more improvement of said properties is necessary, the hot-rolled steel may be further tempered. In such a case, said only temper treating is enough for improving said properties without the known thermal-refining, i.e. normalizing, normalize-tempering, or quench-tempering. Such a temper-treating is carried out at 500° to 680°C. This treatment will greatly improve the absorption energy and transition temperature and at the same time bring the stability and uniformity of yield strength. If the temperature exceeds 680°C., the refined structure obtained through rolling will become coarser and will lower the strengh. Accordingly, the upper limit was set at 680°C.

In the prior art, steels mainly containing Nb or V were hot rolled and the rolling temperature for said steel was controlled in order to impart the desired strength and transition temperature as a high tensile strength material for line pipe. However, the researches on the unstable fracture that are actually seen on the site of line pipe were confirmed. The resistance against the said unstable fracture caused by high pressure gas stream is under the control of the impact absorption energy of steels. Based on the results of such researches, the prior method was reviewed and was found to contain a grave obstacle. Namely, the manufacturing method controlling rolling temperatures as forementioned, although it is effective, encourages the anisotropy of the structure thereby and invites decrease of absorption energy in the transverse direction (direction C) to the longitudinal direction (direction L). In order to improve the absorption energy in direction C, rolling rate in direction C may be increased, but this method has its industrial limitation placed automatically by the width of rolling mill or by the yield. One reason for performing the said heat treatment, such as quench-tempering and the like, in spite of the higher cost for obtaining the steel which has both excellent transition temperature and absorption energy (such as steels K and L to which reference will be made later) resided with this fact. As has been discussed, this kind of heat treatment had industrial problems as its cost was high and the process was complicated. When it was impossible to obtain the steel with desired high transition temperature even with this method, expensive alloying elements such as Ni had to be included in a great amount. The present invention, as has been discussed above, easily and stably secured these properties required at a low cost, and the results of the comparative tests against the present invention steel and the conventional steels are shown in Tables 1 and 2.

Table 1 shows the results where the composition, rolling requirements and heat treating process as the manufacturing requirements are also shown, while Table 2 shows the results of Drop weight tear test = DWTT as provided for by API Standard, 5LS, besides the results of normal 2mm V notch Charpy test as the impact test values in the transverse direction (direction C). In this case, DWTT is different from normal Charpy test and the whole thickness of the sample steel was used. Therefore, its correlation to brittle rupture in the actual structures is considered to be better, and is, for instance, adopted by API Standard 5LXSR6. In the Tables, Steels A–F are the present invention steel, among which Steels E and F are those that have been as only hot rolled, and Steels A–D are those that have been tempered at the temperatures to be described hereinafter after hot rolling. Steels G–L are the comparison steels manufactured in accordance with the conventional methods. Steel G is within the scope of the present invention in respect of its composition, but has no REM (Rare earth metals) and its rolling requirements are different. Steels H and I are examples of Nb containing Aluminum killed steel manufactured for line pipe in the prior art for which the rolling temperature has been controlled. Steel J was rolled by controlled rolling and was given a temper treatment, and steels K and L are examples of conventional steel which is the low alloy steel performed with normal heat-treating.

According to the above Tables, a remarkable difference can be clearly seen between the steels produced in accordance with the present invention process and those produced under conditions which have one or more lack in requirements based on this invention. Further in detail, the lacking requirement of steel G against this invention is only rolling requirements. Even when the addition of rare earth metals is made and said absorption energy increased greatly, the rolling requirements being out of the range of the present invention will produce extremely insufficient results where ${}_{D}T_{C}$ transition temperature does not reach even −10°C. The steels H and I are manufactured under the conditions where the addition of REM which is required by the present invention is absent. The result obtained is such that the ${}_{D}T_{C}$ transition temperature reaches its standard, but the absorption energy is less than 10kg-m at −20°C. This is naturally insufficient resistance required for line pipe in cold areas against said unstable fracture. Steel J has been given tempering treatment after hot rolling to improve the properties of the above mentioned steels H and I, but no REM addition influences said property, consequently, the absorption energy at −20°C is less than 10kg-m. Here the resistance toward the above mentioned unstable fracture is insufficient. As discussed above, the Steels K and L are produced under entirely different conditions from the present invention conditions (particularly in that no addition of REM is made, and in that hot rolling and heat treating requirements), and they have been given the normal heat treating, i.e. quench-tempering. The results obtained is such that said absorption energy and $_DT_C$ transition temperature were meeting needs, but the cost increased and the manufacturing steps became complicated, because of the accompanying heat-treating processes, and they also need to be radically improved.

On the other hand, Steels A–F manufactured in accordance with the present invention process clearly demonstrate excellent properties incomparable to those of comparison steels. For instance, even Steels E and F which have been as only hot-rolled and which are therefore comparatively inferior among the above Steels A–F show the values comparable to the maximum values demonstrated by Steels K and L among the conventional steels. The absorption energy at −20°C after only hot rolling is 15–16kg-m which sufficiently satisfies the standard of 10kg-m, at −20°C, and $_DT_C$ transition temperature of DWTT far exceeds the standard of −40°C and are comparable to those heat-treated Steels K and L. If said temper-treating were to be given within the predetermined temperature to those steels as hot-rolled, then it will be well understood that their low temperature toughness is improved greatly. Those examples are Steels A–D, with the absorption energy at −20°C showing about 20kg-m at −20°C, and said $_DT_C$ of below −60°C. Described in details, the effects of comparison steels I and J by tempering were very small, namely about 3kg-m for said absorption energy and −5°C for $_DT_C$, whereas the tempering effect in the present invention is remarkable. Comparison of Steels A and E or B and F shows that the degree of improvement achieved in this instance is about 9kg-m and 7kg-m for said absorption energy at −20°C, and −11°C and −13°C for $_DT_C$, the said figures being incomparably better than the comparison steels. This more than demonstrates the synergestic effect of REM addition over the tempering effects. It is confirmed that the yield strength in the above examples are within the range of 42–65kg/mm² (hot shown in the above Table II), these being most excellent values over the conventional steels for low temperature services. It is needless to say that the manufacturing cost of this invention steel is very low, because Ni content is low and ordinary heat-treating process is not employed.

TABLE I

| Chemical Composition (Weight %) | | | | | | | | | | Rolling rate of below 950°C | Heat-treating process | | |
|---|---|---|---|---|---|---|---|---|---|---|---|---|---|
| C | Si | Mn | P | S | Cu | Cr | Nb | Ni | Addition amount of REM | | | | |
| 0.06 | 0.32 | 1.62 | 0.009 | 0.005 | 0.26 | 0.25 | 0.036 | 0.16 | 0.09 | 72 | hot-rolling | | air |
| | | | | | | | | | | + | 630°C×30min | | |
| | | | | | | | | | | tempering | | cooling | |
| 0.05 | 0.17 | 1.62 | 0.010 | 0.008 | 0.08 | 0.09 | 0.027 | 0.19 | 0.05 | 55 | " | 600°C×30min | " |
| 0.07 | 0.18 | 1.46 | 0.008 | 0.006 | 0.22 | 0.19 | 0.034 | 0.10 | 0.10 | 55 | " | 650°C×30min | " |
| 0.07 | 0.29 | 1.41 | 0.011 | 0.005 | 0.15 | 0.08 | 0.024 | 0.06 | 0.15 | 48 | " | 550°C×30min | " |
| | | | | Same as above A | | | | | | | | As only hot rolled | |
| | | | | Same as above B | | | | | | | | As only hot rolled | |
| | | | | | | | | | | | hot-rolling | | air |
| | | | | Same as above A | | | | | | 24 | + | 630°C×30min | |
| | | | | | | | | | | | tempering | | cooling |
| 0.13 | 0.25 | 1.32 | 0.013 | 0.008 | 0.09 | 0.26 | 0.023 | 0.12 | — | 30 | | As only hot rolled | |
| 0.07 | 0.21 | 1.43 | 0.010 | 0.006 | 0.24 | 0.25 | 0.036 | 0.16 | — | 69 | | " | |
| | | | | | | | | | | | hot-rolling | | |
| 0.07 | 0.31 | 1.55 | 0.014 | 0.005 | 0.27 | 0.24 | 0.029 | 0.16 | — | 67 | + | 600°C×30 min | air |
| | | | | | | | | | | | tempering | | cooling |
| 0.12 | 0.21 | 1.42 | 0.013 | 0.007 | — | — | — | — | Mo.0.15 | — | 920°C | water-quench | |
| | | | | | | | | | | | | + | air |
| | | | | | | | | | | | 600°C | tempering | cooling |
| | | | | | | | | | | | 910°C | water-quench | |
| 0.07 | 0.24 | 0.49 | 0.015 | 0.006 | 0.33 | 0.12 | — | 0.34 | — | — | | + | air |
| | | | | | | | | | | | 620°C | tempring | cooling |

TABLE II

| | | 2 mm V notch sharpy test(normal test piece) absorption energy | | | | | | | |
|---|---|---|---|---|---|---|---|---|---|
| | | −120°C | −100°C | −80°C | −60°C | −40°C | −20°C | Room Temp. | DWTT D°C |
| Inventive Steel | A | 1.5 | 9.0 | 16.4 | 22.1 | 24.3 | 25.0 | 26.2 | −73 |
| | B | 1.1 | 7.8 | 13.4 | 18.0 | 20.8 | 22.2 | 22.8 | −63 |
| | C | 0.3 | 12.7 | 19.9 | 24.7 | 27.3 | 28.9 | 30.5 | −76 |
| | D | 1.9 | 7.6 | 11.6 | 15.1 | 17.8 | 19.6 | 20.3 | −61 |
| | E | 1.1 | 3.5 | 6.6 | 11.6 | 14.7 | 16.6 | 18.3 | −62 |
| | F | 0.7 | 2.9 | 5.2 | 8.8 | 0.5 | 15.2 | 16.5 | −50 |
| Comparative Steel | G | 0.5 | 0.8 | 2.1 | 4.7 | 9.0 | 15.8 | 21.5 | − 8 |
| | H | 0.7 | 1.1 | 1.4 | 2.1 | 3.9 | 5.7 | 6.4 | −28 |
| | I | 0.8 | 1.6 | 4.0 | 5.7 | 6.5 | 6.9 | 7.1 | −57 |
| | J | 1.4 | 3.5 | 5.6 | 7.9 | 9.2 | 9.6 | 9.7 | −62 |
| | K | 2.2 | 15.3 | 9.8 | 15.2 | 17.0 | 17.3 | 17.5 | −47 |
| | L | 3.8 | 14.3 | 20.6 | 24.1 | 25.2 | 25.5 | 25.5 | −68 |

We claim:

1. A method of manufacturing steel for low temperature services consisting of the following chemical composition,

| | |
|---|---|
| 0.02 to 0.10% C, | 0.10 to 0.50% Si, |
| 1.20 to 1.80% Mn, | up to 0.030% P, |
| up to 0.015% S, | 0.05 to 0.50% Ni, |
| 0.05 to 0.50% Cr, | 0.05 to 0.50% Cu, |
| 0.01 to 0.10% Nb, | unavoidable impurities |

-continued and the balance being Fe, further adding rare earth metal or an alloy thereof of 0.01 to 0.20% to the above steel at the stage of vacuum degassing or of pouring into a mold, and then, being as only hot-rolled at a rolling rate of from 30 to 80% at a temperature below 950°C.

2. A method of manufacturing steel for low temperature services as set forth in claim 1 wherein the hot-rolled steel is further tempered at from 500° to 680°C.

* * * * *

UNITED STATES PATENT AND TRADEMARK OFFICE

CERTIFICATE OF CORRECTION

PATENT NO. : 3,945,858
DATED : March 23, 1976
INVENTOR(S) : HIROYOSHI MATSUBARA et al It is certified that error appears in the above-identified patent and that said Letters Patent are hereby corrected as shown below:

Column 1, line 49: replace "Artic" with --- Arctic ---.

Column 3, line 48: replace "strengh" with --- strength ---.

Columns 5-6, Table I, 11th column: under "72", delete "+ tempering".

Columns 5-6, Table I, 12th column: under "hot-rolling", replace "630°Cx30min." with --- + tempering ---.

Columns 5-6, Table I, 13th column: replace "cooling" with --- 630°C.x30 min. ---;

Columns 5-6, Table I, 14th column: under "air" (first occurrence), insert --- cooling ---.

Columns 5-6, Table I, at left side of the Table, insert the following letter designations for the steels at each line: next to "0.06", add -- A --; at "0.05", add -- B --; at "0.07" (first), add -- C --; at "0.07" (second), add -- D --; at "Same as above A", add -- E --; at "Same as above B", add -- F --; at "Same

UNITED STATES PATENT AND TRADEMARK OFFICE

CERTIFICATE OF CORRECTION

PATENT NO. : 3,945,858

DATED : March 23, 1976

INVENTOR(S) : HIROYOSHI MATSUBARA

It is certified that error appears in the above-identified patent and that said Letters Patent are hereby corrected as shown below:

as above A" (second occurrence), add -- G --; at "0.13", add -- H --; at "0.07" (third), add -- I --; at "0.07" (fourth), add -- J --; at "0.12", add -- K --; at "0.07" (fifth), add -- L --.

Columns 5-6, Table II, in the heading, final column: replace "$D^TC$" with --- $_D{}^TC$ ---.

Signed and Sealed this

Fifth Day of October 1976

[SEAL]

*Attest:*

RUTH C. MASON
*Attesting Officer*

C. MARSHALL DANN
*Commissioner of Patents and Trademarks*